US009453325B2

(12) United States Patent
Church

(10) Patent No.: US 9,453,325 B2
(45) Date of Patent: Sep. 27, 2016

(54) SERRATED PLOW BLADE FOR VIBRATORY PLOW SYSTEMS

(71) Applicant: Jeremy Church, Mount Airy, GA (US)

(72) Inventor: Jeremy Church, Mount Airy, GA (US)

( * ) Notice: Subject to any disclaimer, the term of this patent is extended or adjusted under 35 U.S.C. 154(b) by 0 days.

(21) Appl. No.: 14/511,760

(22) Filed: Oct. 10, 2014

(65) Prior Publication Data

US 2015/0135560 A1 May 21, 2015

Related U.S. Application Data

(60) Provisional application No. 61/897,487, filed on Oct. 10, 2013.

(51) Int. Cl.
*E02F 5/10* (2006.01)
*E02F 3/96* (2006.01)
*E02F 9/28* (2006.01)

(52) U.S. Cl.
CPC ..... *E02F 3/961* (2013.01); *E02F 5/101* (2013.01); *E02F 5/103* (2013.01); *E02F 9/2858* (2013.01)

(58) Field of Classification Search
CPC ..... A01B 13/08; A01B 63/00; E02F 5/102; E02F 5/103; E02F 5/101; E02F 3/961; E02F 9/2858
USPC ..... 37/367, 465; 172/40, 101, 382, 699; 405/180
See application file for complete search history.

(56) References Cited

U.S. PATENT DOCUMENTS

| | | | | |
|---|---|---|---|---|
| 2,632,265 | A * | 3/1953 | Ryan | E02F 5/102 172/382 |
| 3,326,010 | A * | 6/1967 | Gagne | E02F 5/103 172/40 |
| 3,390,533 | A * | 7/1968 | Gremillion | E02F 5/103 172/19 |
| 3,396,804 | A | 8/1968 | Rogers | |
| 3,497,016 | A * | 2/1970 | Ryan | A01B 13/08 172/101 |
| 3,706,207 | A * | 12/1972 | Cornelius | E02F 5/103 172/40 |
| 3,777,500 | A * | 12/1973 | Kelley | E02F 5/103 172/101 |
| 4,087,982 | A | 5/1978 | Golobay | |
| 4,588,034 | A | 5/1986 | Leonard et al. | |
| 4,652,176 | A | 3/1987 | Leonard | |
| 4,924,609 | A | 5/1990 | Martin | |
| 2007/0163788 | A1 | 7/2007 | Carothers | |
| 2010/0044061 | A1 | 2/2010 | Harvey et al. | |

* cited by examiner

*Primary Examiner* — Robert Pezzuto
(74) *Attorney, Agent, or Firm* — Culhane Meadows PLLC

(57) ABSTRACT

Serrated plow blades for vibratory plowing systems are presented. A plow blade assembly in a first embodiment includes a plurality of serrations welded along the leading edge of a plow blade in a substantially contiguous series, for exerting a cutting force on subsoil and underground obstructions. The serrations may have tapered faces and a knife-like upper edge that is oriented at an acute angle relative to the leading edge of the plow blade. In a second embodiment, a plow blade assembly is manufactured from a single plate that is precisely cut to form a blade with integral serrations. These serrated plow blades last longer and the sawing action allows more continuous plowing through subsoil obstructions without stopping.

4 Claims, 3 Drawing Sheets

SERRATED PLOW BLADE FOR VIBRATORY PLOW SYSTEMS

CROSS-REFERENCE TO RELATED APPLICATIONS

This application claims the benefit of U.S. Provisional Application No. 61/889,487, entitled "Serrated Plow Blade for Vibratory Plow Systems," filed Oct. 10, 2013, which is incorporated herein by reference in its entirety.

BACKGROUND

Certain disclosed embodiments relate to a plow blade assembly for use with vibratory plowing machines that are used for inserting cable, conduit, pipe, and the like into the ground without digging a trench and, more particularly, to a plow blade having a toothed or serrated leading edge that provides improved plowing.

Tractors may be equipped with a vibrating motor or vibrator that transmits a rapid and oscillatory motion to a generally elongate plow blade which, when in use, makes a narrow trench in the ground as the tractor pulls the plow blade forward. A cable, conduit, pipe, or other such material may be attached by a lug or other connector to the plow blade, at a desired depth and, thus, installed underground along a desired path without the time, expense, and disruption of digging a wide, open trench.

Existing plow blades include a leading edge that is often tapered and generally smooth along its length. The vibratory plow relies primarily on the oscillating motion and the pulling power of the tractor to move the blade through the soil. A tapered leading edge will cleave and plow through subsoil, as long as the subsoil is generally uniform and without obstructions.

Subsoil obstructions, however, such as stones and tree roots, represent a serious obstacle for most existing plow blades, resulting in serious damage to the blade. Most existing plow blades become substantially worn after only a short period of use in typical soil environments. Worn or bent plow blades quickly lose their cutting ability and present an increased failure risk. Many providers of vibratory plow systems recommend replacing the plow blade when the lowermost toe edge or chisel is worn into a curved shape, when the side plates begin to peel back, or when the entire blade is bent, worn, scratched, or gouged by interaction with subsoil obstructions. Repeatedly replacing bent or worn plow blades significantly increases operating expense and causes delay.

Other plow blades include a leading edge having one or several tooth-like shapes that are widely spaced apart, or located near the top or bottom of the blade. These shapes may exert a force against subsoil obstructions, but only those located at a depth that closely corresponds to the position of the tooth-like shapes on the blade. When encountering subsoil obstructions at other depths, these plow blades are ineffective. The other non-shaped portions of these plow blades typically become substantially worn after only a short period of use. Worn or bent plow blades quickly lose their cutting ability and present an increased failure risk.

Thus, there is a need in the art for improved plow blades that are more durable and provide more efficient plowing.

SUMMARY

In a vibratory plow system having a vibrator for transmitting oscillatory motion to a plow assembly for forming a narrow trench, a plow assembly is described. The plow assembly, according to particular embodiments, has an elongated plow blade extending lengthwise from an upper end to a generally opposing chisel end. The plow blade has a leading edge and a generally opposing trailing edge. The plow assembly has a plurality of serrations disposed along the leading edge in a substantially contiguous series from an intermediate location to near the chisel end, for exerting a cutting force on subsoil during each successive oscillating stroke of the plow assembly as the plow blade moves along a narrow trench formed by the blade. Each of the plurality of serrations having a tapered leading face and a tapered upper side defining an upper edge that is oriented at an acute angle relative to the leading edge, wherein the leading face and the upper edge intersect to define a point. Each of the plurality of serrations has a reinforced tip extending across the point and along at least a portion of both the upper side and the leading face. The plow assembly also has a lug positioned on the trailing edge near the chisel end.

According to other particular embodiments, an elongated plow blade extends lengthwise from an upper end to a generally opposing chisel end, and has a leading edge and a generally opposing trailing edge. The plow blade defines a plurality of serrations disposed along its leading edge. Each of the plurality of serrations has a tapered leading face and a tapered upper side defining an upper edge that is oriented at an acute angle relative to the leading edge, wherein the acute angle ranges from about seventy degrees to about eighty-five degrees, and wherein the leading face and the upper edge intersect to define a point.

Other apparatuses, methods, systems, features, and advantages of the disclosed embodiments will be apparent to one of ordinary skill in the art upon examination of the following figures and detailed description. All such additional apparatuses, methods, systems, features, and advantages are intended to be included within this description and to be included within the scope of the accompanying claims.

BRIEF DESCRIPTION OF THE DRAWING

Features of the various embodiments disclosed will become more apparent in the detailed description, in which reference is made to the appended drawing, wherein.

Corresponding reference numbers indicate corresponding parts or elements throughout the several views of the drawing.

DETAILED DESCRIPTION

Figure 1:
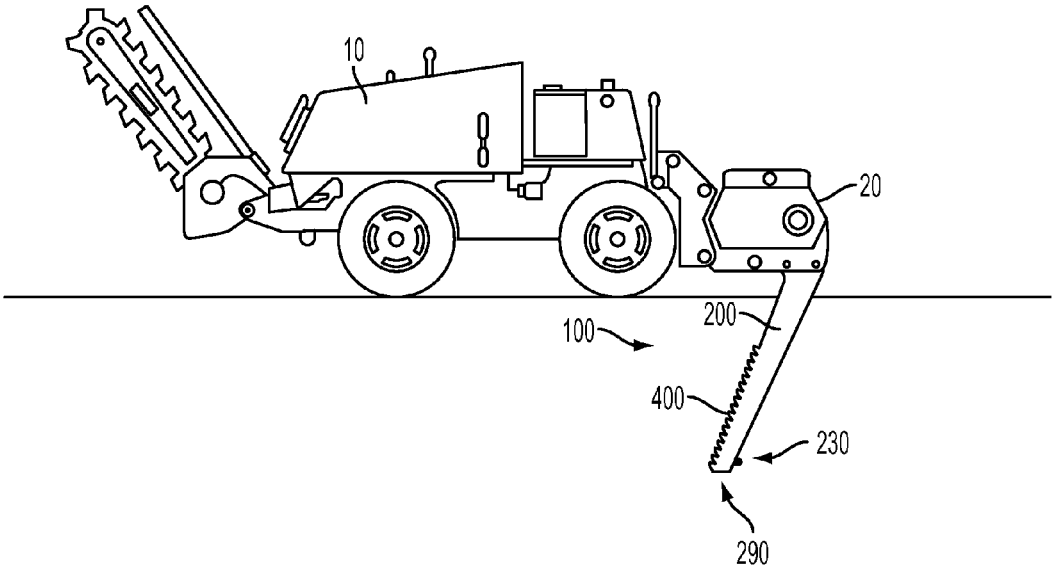
FIG. 1 is a side-view illustration of a wheeled tractor, a vibrator, and a plow assembly in a lowered position for cutting a narrow trench, according to various embodiments.

The present systems and apparatuses and methods are understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

Like parts are marked throughout the following description and drawings with the same reference numerals. The drawings may not be to scale and certain features may be shown exaggerated in scale or in somewhat schematic format in the interest of clarity, conciseness, and to convey information.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to a component can include two or more such components unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Although the systems and methods described herein are discussed in the context of a serrated plow blade for a vibratory plow, the technology disclosed herein is also useful and applicable in a variety of other contexts including those where an improved blade is desired.

As illustrated in FIG. 1, a vibratory plow system may include a vehicle 10 such as a tractor and a vibrating motor (or vibrator 20) that transmits a generally oscillatory motion to a plow assembly 100 for forming a narrow trench in the ground. The motion imparted by the vibrator 20 may be primarily linear but may also include an arcuate and/or orbital component. The plow assembly 100 may include an elongated plow blade 200 having a series of saw-like teeth (or serrations 400) along its leading edge and a lug 230 near its lower end for receiving a cable, conduit, pipe, line, or other material to be installed in the trench. The plow assembly 100 may also include a passageway, chute, cable guide, or other pathway (not shown) for guiding the cable or other material into the trench. The lug 230, as shown, may be positioned on the trailing edge of the plow blade 200 near its lower end (or chisel end 290).

Figure 2:
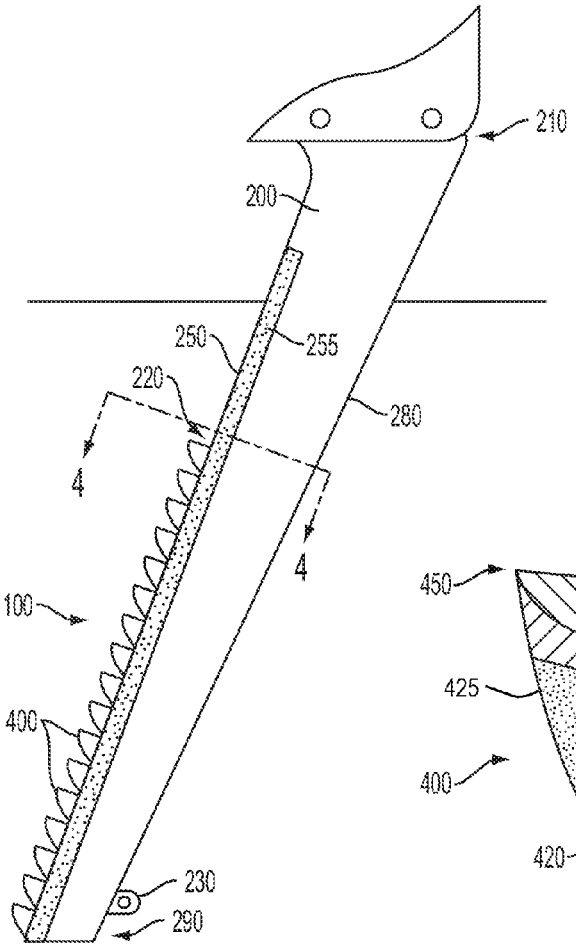
FIG. 2 is a side-view illustration of a plow blade with a series of serrations welded or otherwise attached to its leading edge, according to a first embodiment.

According to a first embodiment, FIG. 2 is a side-view illustration of a plow assembly 100 for use with a vibratory plow system. As shown, the plow assembly 100 includes an elongated plow blade 200 extending lengthwise from an upper end 210 to a generally opposing chisel end 290. The plow blade 200 has a leading edge 250 and a generally opposing trailing edge 280. The plow blade 200 may have a tapered portion 255 near the leading edge 250. The plow blade 200 includes a plurality of saw-like serrations 400 disposed along the leading edge 250 to form a substantially contiguous series of serrations 400 extending from an intermediate location 220 to near the chisel end 290 of the plow blade 200. The term contiguous, as used herein, means that the serrations are located very near one another, with no similar structure intervening therebetween.

In use, the serrations 400 exert a cutting force on the subsoil during each successive oscillating stroke of the plow assembly 100 as the plow blade 200 moves along and through the narrow trench. As shown in FIG. 2, a serrated plow blade assembly 100 may be inserted into the ground such that the leading edge 250 forms an acute angle with the ground surface. At this angle of insertion, the chisel end 290 may be one of the leading portions of the plow blade 200. In use, as described herein, the vibrating motor or vibrator 20 imparts a rapid and oscillatory up-and-down motion to the serrated plow blade assembly 100. For objects such as loose stones, the saw-like teeth or serrations 400 tend to lift such objects upward and toward the surface. For objects such as tree roots, the serrations 400 tend to cut through such objects, much like a reciprocating saw. Most tractors and vibratory plow systems allow the operator to select any of a range of angles of insertion, including an angle that places the plow blade assembly 100 in a nearly vertical orientation. Although the serrated plow blade assembly 100 is illustrated herein using an acute angle of insertion, other configurations and angles of assertion are contemplated, including a nearly vertical or obtuse angles of insertion.

Figure 3:
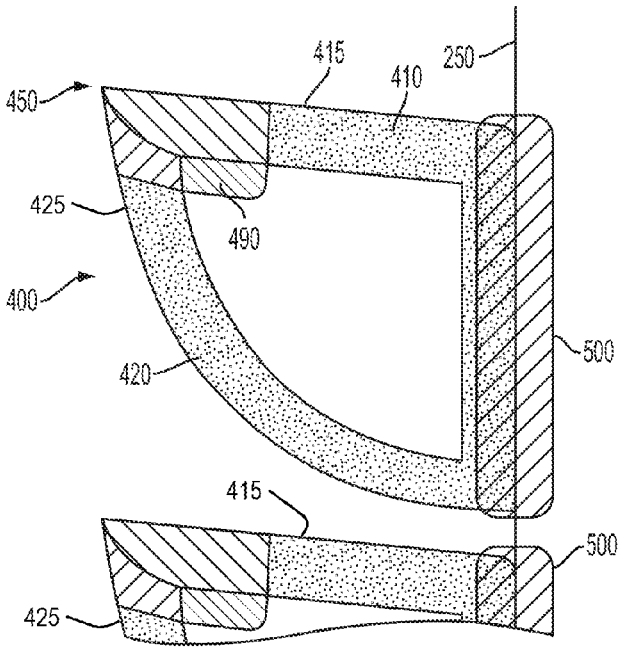
FIG. 3 is a side-view illustration of a serration having a reinforced or carbide tip, and a portion of a next serration, attached to the leading edge of a plow blade, according to the first embodiment.

FIG. 3 is a side-view illustration of a serration 400, and part of an adjacent next serration, attached to the leading edge 250 of a plow blade, according to the first embodiment. The serration 400 may be attached using butt welding or other suitable technique. FIG. 3 illustrates weld material 500 generally surrounding at least a portion of the area between the serration 400 and the leading edge 250. As shown, according to this first embodiment, each serration 400 has a tapered leading face 420 and a tapered upper side 410. The tapered upper side 410 defines a knife-like upper edge 415. The tapered leading face 420 defines a knife-like leading blade edge 425. In this aspect, both the upper edge 415 (along the top) and the leading blade edge 425 (along the front and the bottom) of each serration 400 are shaped like a knifelike ridge, for optimal oscillatory cutting through subsoil obstructions. In some embodiments, the upper side 410 may be about two and one-eighth inches long. The upper edge 415 is oriented at an acute angle relative to the leading edge 250 of the blade 200. In particular embodiments, the upper edge 415 may be oriented such that it forms an angle of about eighty to eighty-five degrees relative to the leading edge 250. In other embodiments, the angle may range from about seventy to eighty-five degrees relative to the leading edge 250. Each serration 400 may be sized and shaped to suit a particular task or plowing project, taking into consideration factors such as soil type, expected subsoil obstructions, trench depth and length, and the like.

The leading face 420 and upper edge 415 intersect at a point 450, as shown. The point 450 and at least a portion of the leading face 420 and upper side 410 may include a reinforced tip 490 made of carbide (tungsten carbide, titanium carbide, or other carbide compounds) or any other desired material for increased durability. The reinforced tip 490 may be formed as an integral part of the material used to make the serration 400 or, alternatively, formed as an added layer of material to be applied onto the serration 400. The reinforced tip 490 may cover a portion of the upper side 410 and a portion of the leading face 420 of the serration 400, as shown. For example, the reinforced tip 490, according to particular embodiments, may extend about three-quarters of an inch along the upper side 410 and three-eighths of an inch along the leading face 420.

Figure 4:
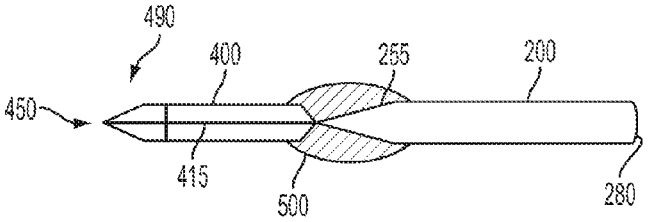
FIG. 4 is a cross-sectional illustration taken along line 4-4 in FIG. 2 and illustrating a serration attached to the leading edge of a plow blade, according to the first embodiment.

FIG. 4 is a cross-sectional illustration, taken along line 4-4 in FIG. 2, showing the plow blade 200 and one of the serrations 400. As shown, the plow blade 200 may have a tapered portion 255 that leads to a relatively narrow leading edge 250. The trailing edge 280 may be squared or slightly rounded. Many plow blades 200 are about one-half inch to three-quarters of an inch in thickness. Each serration 400 may be similar or equal in thickness to the overall thickness of the plow blade 200, as shown in FIG. 4.

According to this first embodiment, each serration 400 may be attached to the leading edge 250 using butt welding or another suitable technique. Butt welding is a technique often used to connect parts that do not overlap. The weld material 500, as shown, generally surrounds at least a portion of the area between the serration 400 and the leading edge 250. In this embodiment, the serrations 400 may be attached to an existing plow blade, without requiring any additional machining or other preparation of the blade. Moreover, in this embodiment, each serration 400 is selectively replaceable, if it becomes damaged or worn. The user can remove the damaged or worn serration and weld a replacement serration onto the leading edge 250.

In another aspect, the serration 400 may be attached in a generally parallel orientation (in other words, at a zero rake angle) relative to the plow blade 200. Alternatively, one or more serrations 400 may be attached at a variety of rake angles, including, for example, attaching serrations 400 at alternating positive and negative rake angles relative to the plow blade 200. Any of a variety of rake angle configurations may be used to suit a particular task or plowing project. For example, in yet another alternative embodiment, the serrations 400 of the serrated plow blade assembly 100 may include repeated sets of three teeth; a first tooth having a negative rake angle, a second tooth having a positive rake angle, and a third tooth having a zero rake angle. A higher rake angle, of course, would produce a wider trench (or, using saw terminology, a wider kerf). In addition to rake angle, any of the other features and alternatives for saws of all types may be incorporated into the making or manufacture of a serrated plow blade assembly 100 as described herein.

Figure 5:
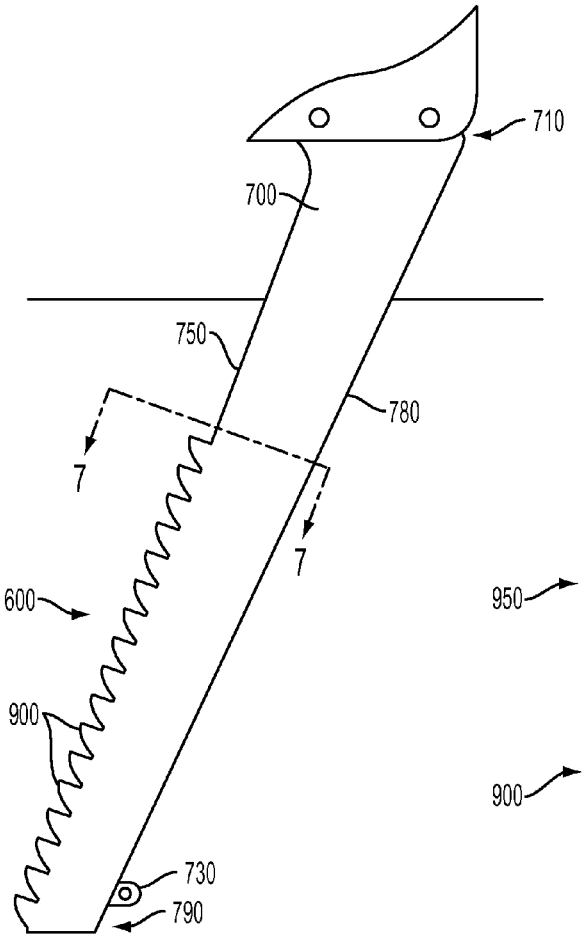
FIG. 5 is a side-view illustration of a plow blade defining a series of serrations along its leading edge, according to a second embodiment.

According to a second embodiment, instead of welding serrations onto a plow blade, the plow assembly 600 may be manufactured by starting with a generally planar steel plate. The plate may be precisely cut to form a single piece that includes the plow blade 700 and serrations 900, as shown in FIG. 5. One or more serrations 900 may include tapered sides and/or a reinforced tip. The plow assembly 600 may be heat-treated, ground, rolled, hammered, brazed, and otherwise processed for a desired precision and durability.

As shown in FIG. 5, the plow assembly 600 includes an elongated plow blade 700 extending lengthwise from an upper end 710 to a generally opposing chisel end 790, having a leading edge 750 and a generally opposing trailing edge 780, and defining a plurality of serrations 900 disposed along the leading edge 750. The serrations 900 may be disposed along the leading edge 750 to form a substantially contiguous series from an intermediate location 720 to near the chisel end 790 of the blade 700.

Figure 6:
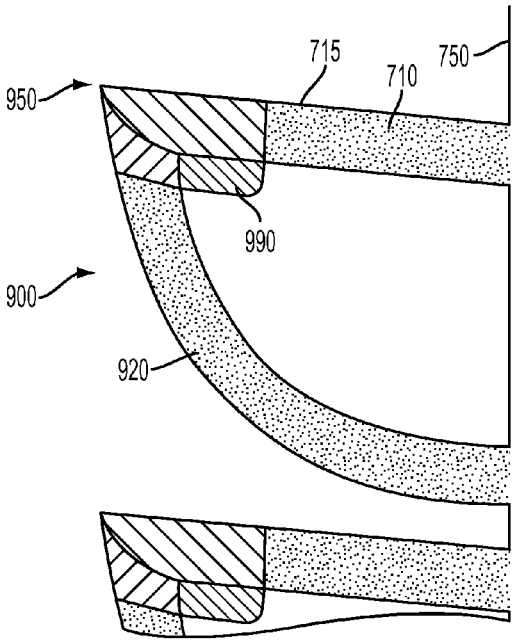
FIG. 6 is a side-view illustration of a serrated portion of a plow blade, and a portion of a next serration, according to the second embodiment.

FIG. 6 is a side-view illustration of a serration 900 relative to the leading edge 750, and a portion of an adjacent next serration, according to the second embodiment. As shown, each serration 900 may have a tapered leading face 920 and a tapered upper side 910 that defines a knife-like upper edge 915. The upper edge 915 may be oriented at an acute angle relative to the leading edge 750. The acute angle may range from about seventy or eighty degrees to about eighty-five degrees. The leading face 920 and upper edge 915 intersect to define a point 950.

One or more of the serrations 900 may include a reinforced tip 990 that extends across the point 950 and along at least a portion of both the upper side 910 and the leading face 920. The reinforced tip 990 may be formed as an integral part of the material used to make the plow assembly 600 or, alternatively, formed as an added layer of material to be applied onto the serration 900.

Figure 7:
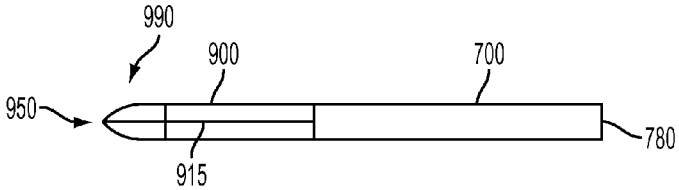
FIG. 7 is a cross-sectional illustration taken along line 7-7 in FIG. 5, according to the second embodiment.

FIG. 7 is a cross-sectional illustration, taken along line 7-7 in FIG. 5. As shown, the plow blade 600 and serration 900 has been formed or manufactured from the same material. The serration 900 is shown at a rake angle of zero relative to the plow blade 600. Alternatively, one or more serrations 900 may be formed at a variety of rake angles to suit a particular task or plowing project.

In use, the tractor may be moved to a selected starting point for a trench. The tractor drive controls may be set to a neutral position with a parking brake engaged. The plow controls may be manipulated in order to place the serrated plow blade assembly (according to any of the embodiments described herein) into a position just above the ground surface. The tractor engine may be stopped while the cable, conduit, pipe, line, or other material is attached to a lug on the blade. With the vibrator in neutral, the tractor engine may be started and the parking brake disengaged. The tractor drive controls may be set to a forward position so that the tractor begins a forward motion. The plow controls may be manipulated in order to lower the serrated plow blade assembly into the ground, and the plow vibrator control may be moved out of neutral to activate the vibrator and begin oscillating the serrated plow blade assembly as it is lowered further into the ground and the tractor moves forward.

As shown in FIG. 2 (and FIG. 5), the serrated plow blade assembly may be inserted into the ground such that the leading edge of the blade forms an acute angle with the ground surface. During plowing, the vibrator imparts a rapid and oscillatory up-and-down motion to the serrated plow blade assembly. During vibratory plowing, the serrations tend to lift objects such as loose stones upward and toward the surface. The serrations also tend to cut through objects such as tree roots, much like a reciprocating saw. Both cutting and durability is improved for embodiments that include a reinforced tip on one or more of the serrations.

Using the serrated plow blade assembly described herein may allow the operator to continue plowing even if one or more of the serrations is damaged or lost during plowing because the remaining serrations continue to exert a force that is sufficient to continue clearing and/or cutting subsoil obstructions without stopping work. Missing or damaged serrations may be replaced or repaired later, after plowing is completed.

Moreover, using the serrated plow blade assembly described herein may allow the operator to continue plowing through subsoil obstructions without stopping. Other plow assemblies require the operator to stop work, raise the blade out of the ground, and manually remove subsoil and/or clear other obstructions by hand. For larger obstructions, other plow assemblies often require operator to stop work, raise, the blade, and then use a digger to create a wider, open trench so that larger obstructions can be removed, cut, or broken into pieces before plowing can resume.

When finished plowing, the tractor drive controls may be set to neutral with the parking brake engaged and the engine speed reduced. The plow vibrator may continue to operate while the serrated plow blade assembly is lifted out of the ground, until the chisel end of the plow blade is almost at ground level. Then, the vibrator control may be moved to neutral.

Although several embodiments have been described herein, those of ordinary skill in art, with the benefit of the teachings of this disclosure, will understand and comprehend many other embodiments and modifications for this technology. The invention therefore is not limited to the specific embodiments disclosed or discussed herein, and that may other embodiments and modifications are intended to be included within the scope of the appended claims. Moreover, although specific terms are occasionally used herein, as well as in the claims that follow, such terms are used in a generic and descriptive sense only, and should not be construed as limiting the described invention or the claims that follow.

The invention claimed is:

1. A vibratory plow system having a vibrator for transmitting oscillatory motion to a plow assembly for forming a narrow trench, said plow assembly comprising:

an elongated plow blade extending lengthwise from an upper end to a generally opposing chisel end, and extending in width from a leading edge to a generally opposing trailing edge;

a plurality of serrations disposed along said leading edge in a substantially contiguous series from an intermediate location to near said chisel end, for exerting a cutting force on subsoil during each successive oscillating stroke of said plow assembly as said plow blade moves along said narrow trench formed by said blade, each of said plurality of serrations having a tapered leading face defining a leading blade edge and a tapered upper side defining an upper edge, wherein said upper edge is oriented at an acute angle relative to said leading edge, and wherein said leading blade edge and said upper edge intersect to define a point, wherein each of said plurality of serrations has a reinforced tip extending across said point and along at least a portion of both said upper side and said leading face; and a lug positioned on said trailing edge near said chisel end.

2. The system of claim 1, wherein said acute angle ranges from about eighty degrees to about eighty-five degrees.

3. The system of claim 1, wherein at least one of said plurality of serrations is selectively replaceable.

4. The system of claim 1, wherein at least one of said plurality of serrations is welded to said leading edge, wherein weld material at least partially surrounds the area between said at least one of said plurality of serrations and said leading edge.

* * * * *